United States Patent [19]

Duffin

[11] 4,075,110

[45] Feb. 21, 1978

[54] FABRIC TREATMENT COMPOSITIONS

[75] Inventor: Bryan Duffin, Wirral, England

[73] Assignee: Lever Brothers Company, New York, N.Y.

[21] Appl. No.: 673,022

[22] Filed: Apr. 2, 1976

[30] Foreign Application Priority Data

Apr. 15, 1975 United Kingdom ..... 15450/75

[51] Int. Cl.[2] ..... D06M 13/20

[52] U.S. Cl. ..... 252/8.8; 8/115.6; 428/279

[58] Field of Search ..... 252/8.8 AJ, 8.75, 8.6, 252/8.9; 8/115.6 A; 428/279

[56] References Cited

U.S. PATENT DOCUMENTS

| | | | |
|---|---|---|---|
| 3,703,840 | 11/1972 | Grand et al. | 252/8.75 |
| 3,712,873 | 1/1973 | Zenk | 252/8.9 |
| 3,909,476 | 9/1975 | Mandell, Jr. | 252/8.6 |

FOREIGN PATENT DOCUMENTS

| | | |
|---|---|---|
| 1,063,629 | 3/1967 | United Kingdom. |
| 1,106,476 | 3/1968 | United Kingdom. |
| 1,124,271 | 8/1968 | United Kingdom. |

*Primary Examiner*—William E. Schulz

*Attorney, Agent, or Firm*—Kenneth F. Dusyn; James J. Farrell; Melvin H. Kurtz

[57] ABSTRACT

A fabric treatment composition comprises a cationic fabric softening material together with a soil release polymer. The polymer is selected from i. Condensation products of dicarboxylic acids, hydroxy polyoxy alkylene compounds and $-NH_2$ compounds or related materials and ii. polyamide alkoxylates.

9 Claims, No Drawings

FABRIC TREATMENT COMPOSITIONS

This invention relates to fabric treatment compositions which contain a cationic fabric softening material or a mixture of such materials. These compositions, when used in the treatment of fabrics in a rinsing process subsequent to a washing operation using a detergent formulation, are known to improve the softness or feel of the treated fabrics and additionally impart a reduced tendency for the fabric to accummulate electrical charges.

It is furthermore advantageous to include in such compositions other rinse conditioning agents which impart additional properties to the treated fabric, e.g. soil release agents, which modify the fabric surface so that an improvement in the soil removal properties is obtained in a subsequent laundering operation.

The removal of soil and especially oily soils and stains from synthetic fabrics present a problem because of the oleophilic nature of such fibres and the low recommended washing temperatures. To assist in the removal of soil from such materials it has been proposed to use soil release agents in a fabric treatment process immediately following the laundering process. These polymeric soil release agents modify the fabric surface through adsorption, thereby imparting hydrophilic properties such that the affinity of the surface for the aqueous detergent system in the subsequent wash process increases, making the removal of oily soils more efficient. The performance of such materials as soil release agents depends to a large part on the amount of the material absorbed onto the fabric surface during the rinse operation.

It has been found in the present invention that the effectiveness of certain classes of polymers, used as soil release agents, is superior when the cationic softening materials, present in the formulation, are selected to be in the class which form a disperse phase in water as opposed to being in solution therein. The soil release agent used in combination with these fabric softening materials is selected from one of the two following generic classes of polymers or mixtures thereof. The generic classes are:

(A)

i. condensation products of
   a. an aliphatic dicarboxylic acid, or an ester- or amide-forming derivative thereof;
   b. a hydroxy-polyoxy-alkylene compound containing at least one polyalkylene chain consisting of a plurality of oxyalkylene radicals linked directly to one another, or an ester- or amide-forming derivative thereof; and
   c. a compound selected from the groups
      1. an aliphatic or cycloaliphatic amino acid or lactam,
      2. an aliphatic or cycloaliphatic diamine or salt thereof with an aliphatic dicarboxylic acid, 3. a mixture of the amino acid or lactam compound with the diamine compound or salts thereof, and
      4. an ester- or amide-forming derivative of reactants (1), (2) or (3) above; and ii. a reaction product of an alkylene oxide with polyamide; these will be used in admixture with (B) a cationic fabric softener compound having a solubility in water not greater than 500 parts per million (ppm) at 25° C, and (C) an aqueous medium.

UK patent specification 1,124,271, the disclosure of which is incorporated herein by reference, discloses examples of condensation products of class A (i). The salts of hexamethylene diamine and adipic acid in the molar ratio of 1:1 (hereafter referred to as a "nylon" salt) is an example of the salts which may be used in these condensation products. The condensation product A (i) preferably contains about 10% to about 80% by weight of each of the three couponents (a), (b) and (c)

Alkylene oxide-polyamide reaction products of class A (ii) prepared by the reaction of alkylene oxides, e.g. ethylene oxide, propylene oxide with polyamides, the preferred weight ratio being from about 0.2:1 to 10:1, more preferably from about 0.5:1 to about 4:1 alkylene oxide to polyamide. Examples of polyamides include those prepared by the polymerisation of amides, for example caprolactam, polycondensation of dicarboxylic acids with diamines, for example adipic acid and hexamethylene diamine. Specific examples of these polymers are described in UK patent specifications 1,063,629 and 1,106,476. The Applicants have found that these polymers can be used in combination with specific cationic softening materials to provide particularly good soil release properties on polyamide materials.

The fabric treatment composition of the invention will contain a cationic fabric softening material having a solubility in water at 25° C of not more than 500 ppm, preferably not more than 50 ppm. The preferred cationic softening agents correspond to the formula $[R_1R_2NR_3R_4]^+X^-$, where $R_1$ is hydrogen, benzyl, an alkyl or hydroxyalkyl group of from 1 to 5 carbon atoms, $R_2$ is an alkyl group having from 8 to 24 carbon atoms and $R_3$ and $R_4$ are each hydrogen or an alkyl group containing 1 to 24 carbon atoms. The alkyl group may be linear or branched, saturated or unsaturated and may contain substituents along their length. Commonly the alkyl groups contain a mixture of chain lengths as derived from naturally occurring oils and fats, e.g. tallow and coconut oil.

The anion $X^-$ may be for example halide (chloride, bromide, iodide), methyl sulphate, acetate, nitrate, sulphate, formate.

Examples of cationic softening materials of this type which also have the preferred solubility characteristics are:

distearyl dimethyl ammonium chloride
di-hydrogenated tallow dimethyl ammonium chloride
di-eicosyl dimethyl ammonium chloride
di-3-stearylamidopropyl dimethyl ammonium chloride
di-2-stearylamidoethyl ammonium formate
tri-2-stearyloxyethyl methyl ammonium methyl sulphate
di-2-palmitoyloxyethyl dimethyl ammonium methyl sulphate
stearylamidomethyl dimethyl ammonium acetate.

The invention also includes cationic softening agents in which the nitrogen atoms are contained within an aromatic or alicyclic ring. Examples of preferred materials of this type are:

2-heptadecyl-1-methyl-1-stearoyl amido ethyl imidazoline methyl sulphate.
docosyl pyridinium bromide
docosyl ethyl morpholinium chloride.

The cationic fabric softeners set forth above can be used singly or in combination in the practice of the present invention.

It is sometimes desirable to include minor amounts of other fabric softening agents of the nonionic, anionic, or amphoteric type in mixture with the cationic fabric softeners of the invention. Provided the disperse phase of the mixture in water is still cationic during the application to the fabric and the solubility limits are met the teaching of this invention still applies.

Examples of such additional materials are:

dihydroxyethylstearylamine
hydroxyethyldistearylamine
dihardened tallow methyl amine
N stearoyl, N' hydroxyethyl ethylene diamine
oleyl 1,3, propylene diamine
tallow soap
stearyl amine oxide
Ceramic HC39 (Sandoz)-a reaction product of stearic acid
(2 moles) and N-hydroxyethyl ethylene diamine (1 mole)
Tallow mono and di-ethanolamides.

The amount of fabric softener material in the formulation will preferably be in the range from about 1% to about 60% by weight, preferably from about 2% to about 20% by weight. At the higher concentrations of softener it is probable the formulation would move from a liquid form into a pasty or semi-solid mass. The amount of soil release agent in the product will usually be from about 0.1% to about 10% by weight, preferably 0.25% to about 5% by weight. The products will be in the form of aqueous solutions which may also contain other materials, for example hydrotropes, fluorescers, short chain alcohols, for example isopropanol.

The compositions of the invention provide polyamide fabrics with increased water wetting and transport compared with treatment with fabric softener materials alone. A fabric softener will reduce the hydrophilic nature of the fabric surface but use of a composition containing a polymer from the two classes defined will lessen the reduction in hydrophilic properties.

Synthetic fabrics, such as polyamide, accumulate static electricity which leads to increased dust pick-up, attraction of soil and clinging of garments to the body and other fabrics. Use of polymers of the classes defined reduce this problem by forming a more conductive layer on the fibre surface.

Examples of formulations of the invention were studied using the following test procedure.

Two fabric pieces each of 6 inches × 7 inches were treated by immersion in a rinse solution containing a soil release polymer and a cationic material. The rinse application was carried out in a Terg-O-Tometer (United States Testing Co Ltd of Hoboken N.J.) for 5 minutes at 50 rpm and 25° C and with a water hardness of 24° H.

After subsequent water rinsing and drying, a 2 inch × 2 inch fabric piece was cut from each 6 inch × 7 inch piece and these two fabric squares were soiled in a standard manner with approximately 0.035g of dirty sump oil. After measuring the reflectances of the stains using a Zeiss Elrepho reflectometer, the soiled pieces were washed together once in the Terg-O-Tometer in 1 liter of a 0.13% solution of a typical anionic detergent product. After a 10 minute wash at 50° C and 100 rpm the fabric squares were rinsed and dried and the reflectances of the stains were remeasured.

Percentage soil removal values were determined from the reflectance measurements.

In the following Examples the abbreviations used for the cationic materials are:

DDAC — Ditallow dimethyl ammonium chloride (obtainable under the trade name Arquad 2HT)
CTAB — Cetyl trimethyl ammonium bromide
HMSI — 2-heptadecyl-1-methyl-1-stearoyl amidoethyl imidazoline methyl sulphate (obtainable under the description Softener 121 from Union Carbide)
DSAF — Di-2-stearyl amido ethyl ammonium formate
AHAC — 3-acyl oxy-2-hydroxypropyl trimethyl ammonium chloride in which the acyl group is derived from $C_{16}$–$C_{22}$ fatty acid with 65% of $C_{22}$ material.

EXAMPLE 1

A sump oil soil release test was performed on bulked polyamide fabric using the method described and using a polymer prepared as a condensation product of a polyamide and an ethylene oxide and containing 3.3% nitrogen. This polymer, known under the trade name "Luratex A25" was used at a concentration of 5 parts per million (ppm) in the rinse solution together with a cationic material of a type and concentration (by weight in volume) listed below. The concentration of CTAB in this and the following examples was chosen so that an appreciable fabric softening was detectable. CTAB has a solubility in water of about 10g per 100 ml water and the other four cationic materials have solubilities of less than about 500 ppm at 25° C.

A similar treatment was performed with the polymer omitted from the rinse solution.

The precentage soil removal for each rinse composition is quoted with the values omitting polymer given in parenthesis.

| Rinse composition | 1st rinse | 2nd rinse | 3rd rinse |
|---|---|---|---|
| DDAC (0.015%) | 71 (52) | 85 (71) | 93 (71) |
| CTAB (0.05%) | 42 (33) | 53 (43) | 60 (39) |

EXAMPLE 2

Example 1 was repeated using a polymer prepared from 2 moles adipic acid, 1 mole polyoxyethylene glycol (Mol.Wt. 1540), 10% by weight of the total reactants of a salt of hexamethylene diamine and adipic acid in the molar ratio of 1:1, and caprolactam present at 42% by weight of the final polymer. The polymer was used at a concentration of ten parts per million in the rinse solutions. The percentage soil removal values were:

| Rinse composition | 1st rinse | 2nd rinse | 3rd rinse |
|---|---|---|---|
| DDAC (0.012%) | 80 (52) | 95 (70) | 98 (70) |
| CTAB (0.05%) | 53 (33) | 70 (43) | 65 (39) |

EXAMPLE 3

Using the polymer in Example 1 at a concentration of 20 parts per million in the rinse solutions, Example 1 was repeated using an alternative cationic disperse softening material in the rinse solutions.

| Rinse composition | 1st rinse | 2nd rinse | 3rd rinse |
|---|---|---|---|
| HMSI (0.015%) | 69 (37) | 95 (52) | 97 (55) |
| CTAB (0.05%) | 52 (33) | 59 (43) | 63 (39) |

EXAMPLE 4

Example 2 was repeated using HMSI in the rinse solutions.

| Rinse composition | 1st rinse | 2nd rinse | 3rd rinse |
|---|---|---|---|
| HMSI (0.015%) | 93 (37) | 98 (52) | 98 (55) |
| CTAB (0.05%) | 52 (33) | 70 (43) | 65 (39) |

EXAMPLE 5

Example 3 was repeated using the disperse cationic softening material DSAF in the rinse solutions.

| Rinse composition | 1st rinse | 2nd rinse | 3rd rinse |
|---|---|---|---|
| DSAF (0.015%) | 45 (22) | 95 (32) | 97 (45) |
| CTAB (0.05%) | 52 (33) | 59 (43) | 64 (39) |

EXAMPLE 6

Example 2 was repeated using DSAF in the rinse solutions

| Rinse composition | 1st rinse | 2nd rinse | 3rd rinse |
|---|---|---|---|
| DSAF (0.015%) | 73 (22) | 91 (32) | 96 (45) |
| CTAB (0.05%) | 53 (33) | 70 (43) | 65 (39) |

EXAMPLE 7

Example 3 was repeated using the disperse cationic material AHAC in the rinse solutions.

| Rinse composition | 1st rinse | 2nd rinse | 3rd rinse |
|---|---|---|---|
| AHAC (0.015%) | 80 (48) | 94 (56) | 95 (63) |
| CTAB (0.05%) | 52 (33) | 59 (43) | 64 (39) |

EXAMPLE 8

The polymer described in Example 2 was used at a concentration of 5 parts per million in rinse solutions containing a disperse cationic softening material AHAC.

| Rinse composition | 1st rinse | 2nd rinse | 3rd rinse |
|---|---|---|---|
| AHAC (0.015%) | 85 (48) | 90 (56) | 93 (63) |
| CTAB (0.05%) | 45 (33) | 62 (43) | 52 (39) |

EXAMPLE 9

Experiments were performed to determine the water wetting and transport of washed and rinsed samples of bulked nylon fabric. Pieces of bulked nylon fabric were washed in a typical anionic detergent product and rinsed in compositions of the present invention. The pieces were subjected to three cycles and then strips 12 inches by 1½ inches were cut from the pieces and suspended with the lower end in water. The height of water rise was measured after 15 mimutes and expressed in inches. The heights of wetting were

| Treatment | Height (inches) |
|---|---|
| Rinse omitted | 4.6 |
| DDAC (0.015%) | 1.9 |
| DDAC (0.015%) + Example 2 polymer (10 ppm) | 3.5 |

-continued

| Treatment | Height (inches) |
|---|---|
| DDAC (0.015%) + Example 1 polymer (10 ppm) | 3.1 |

These results demonstrate the polymers have reduced the hydrophilic character of the fibre surface brought about by deposition of the DDAC thereon. The polymers have increased the water wetting and transport.

What is claimed is:

1. A fabric treatment composition comprising

A. from about 0.1% to about 10% by weight of i. a condensation product of (a) an aliphatic dicarboxylic acid, or an ester- or amide-forming derivative thereof; (b) a hydroxypolyoxy-alkylene compound containing at least one polyalkylene chain consisting of a plurality of oxyalkylene radicals linked directly to one another, or an ester- or amide-forming derivative thereof; and (c) a compound selected from the groups 1. an aliphatic or cycloaliphatic amino acid or lactam,
2. an aliphatic or cycloaliphatic diamine or salt thereof with aliphatic dicarboxylic acid,
3. a mixture of the amino acid or lactam compound with the diamine compound or salts thereof, and
4. an ester- or amide-forming derivative of reactants 1), 2) or 3) above; or ii. a reaction product of an alkylene oxide with polyamide; in an admixture with B. from about 1% to about 60% by weight of a cationic fabric softener compound having a solubility in water not greater than 500 parts per million at 25° C and C. an aqueous medium.

2. A composition according to claim 1 containing from about 0.25% to about 5% by weight of component A.

3. A composition according to claim 1 containing from about 2% to about 20% by weight of component B.

4. A composition according to claim 1 wherein the condensation product (A) (i) contains from about 10% to about 80% by weight of each of the three components (a), (b) and (c) of paragraph (A) (i).

5. A composition according to claim 1 wherein the reaction product (A) (ii) is formed by reacting the alkylene oxide and polyamide in a weight ratio of from about 0.2:1 to about 10:1.

6. A composition according to claim 1 wherein the alkylene oxide is ethylene oxide.

7. A composition according to claim 1 wherein the cationic fabric softener has a solubility not greater than 50 parts per million.

8. A composition according to claim 1 wherein the fabric softener has the formula $$[R_1R_2NR_3R_4]^+X^-$$

wherein $R_1$ is hydrogen, benzyl, alkyl or hydroxyalkyl with 1 to 5 carbon atoms, $R_2$ is an alkyl group with 8 to 24 carbon atoms, $R_3$ and $R_4$ are each hydrogen or an alkyl group with 1 to 24 carbon atoms, and $X^-$ is an anion.

9. A composition according to claim 1 wherein the reaction product (A) (ii) is formed by reacting the alkylene oxide and polyamide in a weight ratio of from about 0.5:1 to about 4.1.

* * * * *